US008136689B2

(12) United States Patent
Ulstein et al.

(10) Patent No.: US 8,136,689 B2
(45) Date of Patent: Mar. 20, 2012

(54) DEVICE FOR BEVERAGE CAN

(76) Inventors: Herleif Ulstein, Gursken (NO); Hugo Lloyd Ulstein, Gursken (NO)

( * ) Notice: Subject to any disclaimer, the term of this patent is extended or adjusted under 35 U.S.C. 154(b) by 619 days.

(21) Appl. No.: 12/089,418

(22) PCT Filed: Oct. 6, 2006

(86) PCT No.: PCT/NO2006/000348

§ 371 (c)(1),
(2), (4) Date: Sep. 11, 2008

(87) PCT Pub. No.: WO2007/043890

PCT Pub. Date: Apr. 19, 2007

(65) Prior Publication Data

US 2009/0194536 A1 Aug. 6, 2009

(30) Foreign Application Priority Data

Oct. 7, 2005 (NO) ..... 20054623

(51) Int. Cl.
*B65D 53/08* (2006.01)
*B65D 51/18* (2006.01)

(52) U.S. Cl. ..... 220/372; 220/258.2; 220/258.3; 220/906

(58) Field of Classification Search ..... 220/372, 220/258.2, 258.3, 370, 906
See application file for complete search history.

(56) References Cited

U.S. PATENT DOCUMENTS

| | | | | |
|---|---|---|---|---|
| 4,537,326 | A * | 8/1985 | Morehead | 220/269 |
| 5,131,556 | A * | 7/1992 | Iioka et al. | 220/270 |
| 5,555,993 | A * | 9/1996 | Borkowski et al. | 220/269 |
| 5,647,497 | A * | 7/1997 | Labbe | 220/257.2 |
| 5,720,412 | A * | 2/1998 | Ficken | 220/703 |
| 5,775,534 | A * | 7/1998 | Webb et al. | 220/269 |
| 5,845,801 | A * | 12/1998 | Heitl | 220/269 |
| 5,887,742 | A * | 3/1999 | Lewis | 220/253 |
| 6,427,861 | B1 * | 8/2002 | Cho | 220/269 |
| 6,755,315 | B1 | 6/2004 | Mueller | |
| 2002/0088802 | A1 * | 7/2002 | DeRose | 220/258.2 |
| 2004/0178201 | A1 * | 9/2004 | Cox et al. | 220/258.2 |

FOREIGN PATENT DOCUMENTS

| | | | |
|---|---|---|---|
| DE | 44 38 069 | A1 | 5/1996 |
| DE | 196 32 572 | A1 | 2/1998 |
| DE | 199 14 048 | A1 | 9/2000 |
| DE | 199 42 827 | A1 | 3/2001 |
| GB | 2 304 323 | A | 3/1997 |
| WO | 02/04304 | A1 | 1/2002 |
| WO | 02/26565 | A2 | 4/2002 |
| WO | 2004/050490 | A1 | 6/2004 |

* cited by examiner

*Primary Examiner* — Mickey Yu
*Assistant Examiner* — Niki Eloshway
(74) *Attorney, Agent, or Firm* — Young & Thompson

(57) ABSTRACT

The present invention concerns a filter element (310, 410) for a conventional beverage can (1, 2), with a top of a can (100) comprising a pull tab with a fixing (103), a tab (110) and a sealing element (101) which at least adjoins to a punch edge (102) of an opening of the can, wherein the filter element has an area which at least covers the entire said opening when the can is opened, wherein the filter element (310, 410) is adapted to be fastened to the top side of the top of the can (100) either by the fixing (103) of the pull tab or adherence directly to the top of the can (100).

49 Claims, 6 Drawing Sheets

4A

4B

6A

6B

DEVICE FOR BEVERAGE CAN

FIELD OF THE INVENTION

The present invention relates to a beverage can, a top of a can and a device for a beverage can, especially a can for soda or beer, in order to hinder insects and other unwanted objects from entering into the beverage can after being opened and for keeping the contact area of the can hygienically clean.

BACKGROUND OF THE INVENTION

Beverage cans are commonly used as portion containers for different kinds of beverages, such as soda, juice, beer and similar liquids. Beverage cans are normally produced in aluminum and has the advantage of being light weighed, durable, resilient against corrosion and recyclable. The disadvantage with such beverage cans, in relation to other beverage containers such as bottles made from plastic or glass, is that beverage cans are not so easily closed such as with a screw cap. In other words, an opened can normally stays open until it is either emptied or discarded, regardless of its volume.

This is a problem, especially considering the possibility that unwanted and foreign elements, e.g. insects, may enter the beverage can after it has been opened. Normally, an opened can is not emptied immediately, and the user often leaves the can unattended on a table or on the ground, e.g. while the user is eating or is focusing his/her attention on something else. The possibility for the can being contaminated by insects like wasps or bees, which are attracted by the sweet content of the can before the can is emptied, is therefore high. The insect does not only represent a unappetizing foreign body, but also a real safety hazard for the user, as the user may be stung in the mouth area or throat by the insect, when he/she drinks from the can again. Such stings can cause potential lethal situations, such as allergic reactions or swelling of proximate organs, which may cause serious conditions leading to hospitalization or in the worst case risk of suffocation.

Previous attempts to find a solution to this problem are known. Many of these solutions are based on complicated extra parts that have to be fastened or mounted on the beverage can during use, such as a cover that may be mounted on the can.

From US 2004/006566 a cap is provided for inserting into the opening of the can covering the opening and providing a seal.

These solutions are impractical as the user has to buy such covers separately. Furthermore, the user tends to forget bringing such accessory along and the covers are not used. The covers are also expensive to produce; they often fall off easily, quite simply because they are removable and hard to fasten sufficiently. A factory made mounting of such a cover, or a bundled kit with extra cover would be an unfavorable solution to the above problems as it would cause logistical problems regarding delivery, handling and storage of cans which are systemized and automated processes adapted to the "normal" shape, size and specifications of the present conventional cans.

Other suggested solutions are based on complicated devices that require special fastening to the can which will require specialized parts being produced and mounted during the production of the can and often requires specialized cans.

From DE 40 38 329, a filter device mounted by special pegs to the inner side of the top of a can is known.

From WO 97/1986 1 a similar filter device is fastened in various manners to the inner side of the top of the can.

In both of the above documents the filter device is dependant on the scaling element being either removed or pressed sufficiently into the can in order for the filter to flip back up against the opening of the can. However, the filter may during this process be damaged. Also, as often experienced, the sealing element does not always bend completely into the can and the filter will then not close around the opening of the can. In addition, aluminum lacks resilience in order to flip up in the required manner. In WO 97/1986 this has been proposed solved by extending the length of the filter element e.g. in a semi circular form in order to not bend the filter element permanently into the can. This requires non-standard fixing to the top of the can and still it is not evident that the spring power of the filter element will provide sufficiently closure to the opening.

From U.S. Pat. No. 5,285,924 a can cover is known, where a turnable plastic cover is used to close and reopen a can, but without a filtering function. The disadvantage with this solution, in addition to the reasons mentioned above, is that the cover is fastened over the top edge of the can, which would causes the cover to easily break, during storage and shipping, if mounted from the producer. It can also be disruptive to logistics if it breaks or falls of and a further problem is that it is not recyclable together with the aluminum can. Moreover the user will most likely not use this cover consistently because it is impractical to use and the user may forget to close the cover every time he/she uses the can.

In US patent 2005/0150895 some of the problems mentioned earlier, have been attempted to be solved, by placing a screen covering the opening of the can from the inside of the can. When the can is opened, the sealing element of the can, which is pushed down into the can during opening, presses the screen out and downwards into the can. The problem with this solution is that it is relatively complicated to mount such a screen properly and safe to the underside of the top of the can during production, and it will require changes in the production method and equipment thereof. The sealing element also risks pulling the screen apart and destroying it if said elements are not correctly placed and abutting each other before the can is opened. Furthermore, this document offers no complete solution to the problem regarding insects, because the sealing element is of such a depth that it allows for smaller insects to fit into the "screen basket". Once the insect is in place in this screen basket, it is well positioned to sting the user. The user will not necessarily be aware of the insect, as he/she would have to look directly into the opening in the top of the can to see any potential intruders. Therefore, this solution is insufficient e.g. in poor lighting, if the user of the beverage can has poor vision or is easily distracted such as in the case of a child.

Another attempted solution is known from U.S. Pat. No. 5,617,970 wherein a cover may be placed over the opening of the can, and clamped by the tab on the top side of the can being rotated 180 degrees, and thereby holding the filter in place. This cover is a flat metallic plate with a plurality of holes and is placed directly under the hole in the tab of the can. In this manner the content of the can will be poured through the hole in the tab. The most important inconvenience with this solution is that it is difficult to bend the tab downward and onto the can in order to apply pressure against the cover, and that the actual space for filtering holes inside the hole of the tab is very limited. Furthermore, the content of the beverage may easily flow out on the sides of the filter/tab and onto the user being covered in sticky/sweet liquid. In addition, it will be uncomfortable to drink from the can because the thickness of the filter/tab makes it difficult to close/seal the mouth against the can. An added awareness should also be taken against the hazard that children might be tempted to bite on filter/tab, which might injure their mouth or teeth.

From DE 199 09 861 a 180 degree turnable tab with an integrated filter is known, which partially covers the opening of the can. The filter is locked into place over the hole with a set of small protrusions on the edges of the tab that are squeezed in below the edge of the opening of the can. A disadvantage with this and the previous solution is that the user runs the risk of squeezing or cutting his/her fingers or parts of the mouth, especially the tongue, in the wedged opening between the protrusions of the tab and the edges of opening of the can. Children are especially exposed in this solution. The rotation of the tab, in this and the previous solution, may further break the peg that fastens the tab to the can if the user is too quick or not gentle enough in the operation. The tab in conventional cans is not intended to be rotated, except for 90 degrees vertically and will easily break. This will also be a problem in the attempted solution suggested in U.S. Pat. No. 5,617,970 above. Further, the solution does not cover the opening of the can sufficiently against small insects such as ants, mosquitoes and midge etc.

It therefore exist a need for a device that completely covers the entire opening of the can and effectively hinders insects in entering an opened can. The device should follow the can as an integrated part of the can e.g. a part of the can or be pre mounted by the producer of the can or the user. The solution must be robust yet simple to use, and comfortable to drink from. It should be compatible with existing production and logistical operations, without the need for changes to be made to existing handling, storage and transport of the items equipped with the present invention.

Since cans are not transparent, such as plastic and glass bottles, it is also difficult to become aware of unwanted elements inside a can. This fact requires great trust in the producer as well as responsibility of the producer to make sure that no unwanted objects enter the can during production or are formed during storage. There is also a need for a solution that may protect both the manufacturer and the consumer against such incidents, although such cases are rare.

Further, there is a need for a solution that hinders dirt and bacteria contaminate the drinking area of the can, especially if the can is equipped with the functions described in the above.

From JP 07291383 a hygienically cover is known, fastened to a pull top releasing type which is removed together with the pull top to expose a clean area for the users lips.

From GB 2 294 445 a removable sealing film is known for keeping the area of contact with the user clean.

In U.S. Pat. No. 6,378,718 a protections element is provided with two laminar portions being hermetically superimposed and hinged which may be separated to reveal a clean surface around the opening of the can and providing a clean surface along the walls of the can.

However, none of these hygienic sealing solutions provides any hindrance against insects or unwanted object from entering the can.

SUMMARY OF THE INVENTION

The objective of the invention is to provide a solution to the problems mentioned above by providing a filter element adapted to a conventional beverage can providing filtering or screening and preferably hygienic protection for the user of the can.

The invention thus concerns a filter of screen element for a conventional beverage can, with a top of a can comprising a pull tab with a fixing, a tab and a sealing element which at least adjoins to a punch edge of an opening of the can, wherein the filter element has an area which at least covers the entire said opening when the can is opened, characterized in that the filter element is adapted to be fastened to the top side of the top of the can either by:

the fixing of the pull tab; or adherence directly to the top of the can.

The invention also concerns a top of can and a beverage can provided with such a filter element.

DETAILED DESCRIPTION

Figure 1:
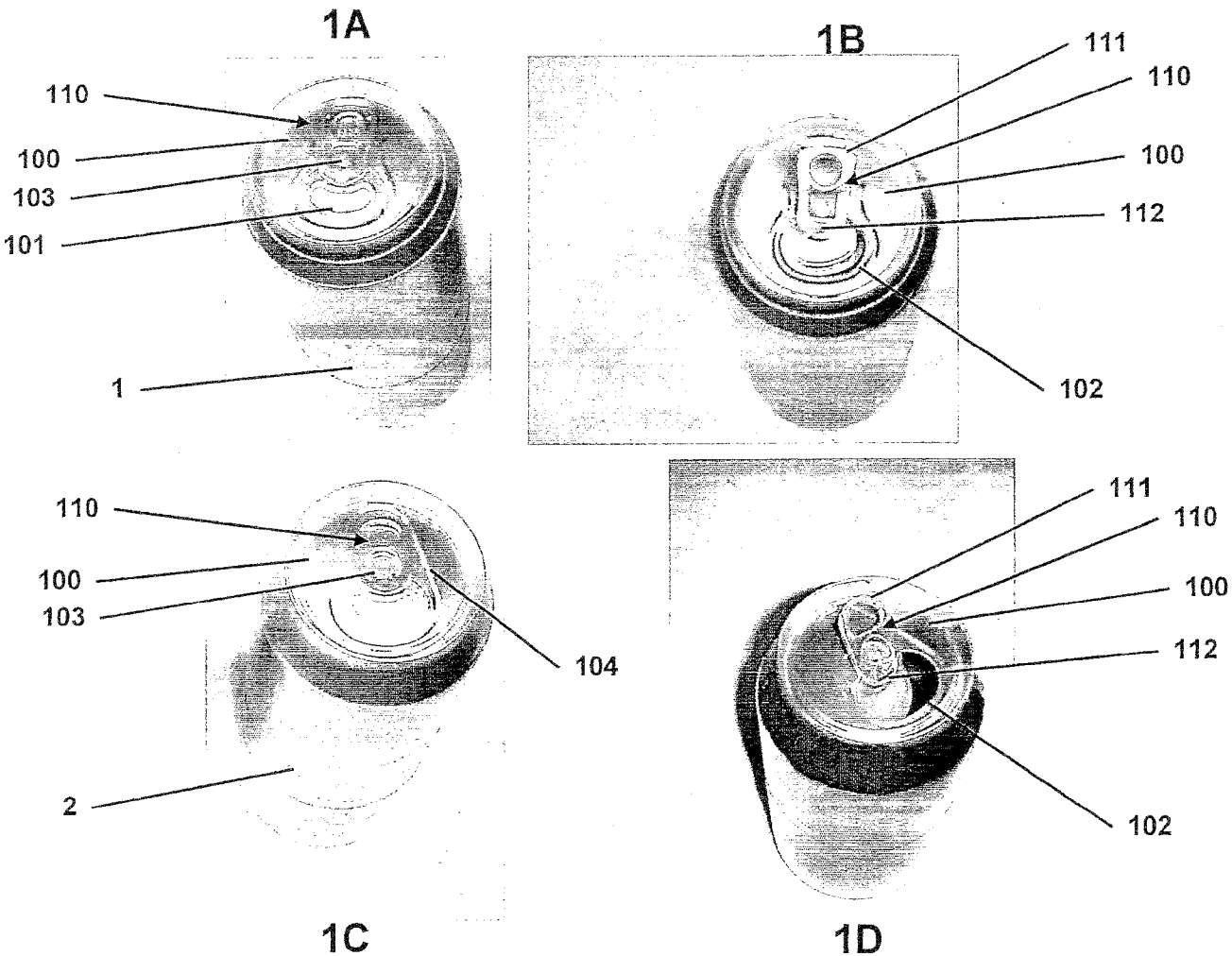
FIG. 1 shows a first and a second type of conventional beverage cans with tabs of prior art.

As shown in FIG. 1, a regular beverage can 1A or 1B includes a top of the can 100, wherein a sealing element 101 is punched out adjoining the punch edge 102 of the top of the can. The sealing element 101 and the punch edge 102 are often positioned in a recess or encompassed by grooves or ridges 104 reinforcing the top of the can in the area around the punch edge 102, in order for the punch mechanism to break more easily when the can is opened. Further, a fixing 103 creates a point of fixture for a tab 110 to the can, most frequently by the use of a peg. In order to open the can the tab 110 is lifted so that a press part 112 of the tab 110 is pressed downward against the sealing element 101, which will subside and create an opening in the can along the punch edge 102 in the top of the can 100. A normal grip for opening such a can is to place the thumb over the sealing element 101 and to use the index finger or middle finger to raise the handle 111 of the tab 110.

Figure 2:
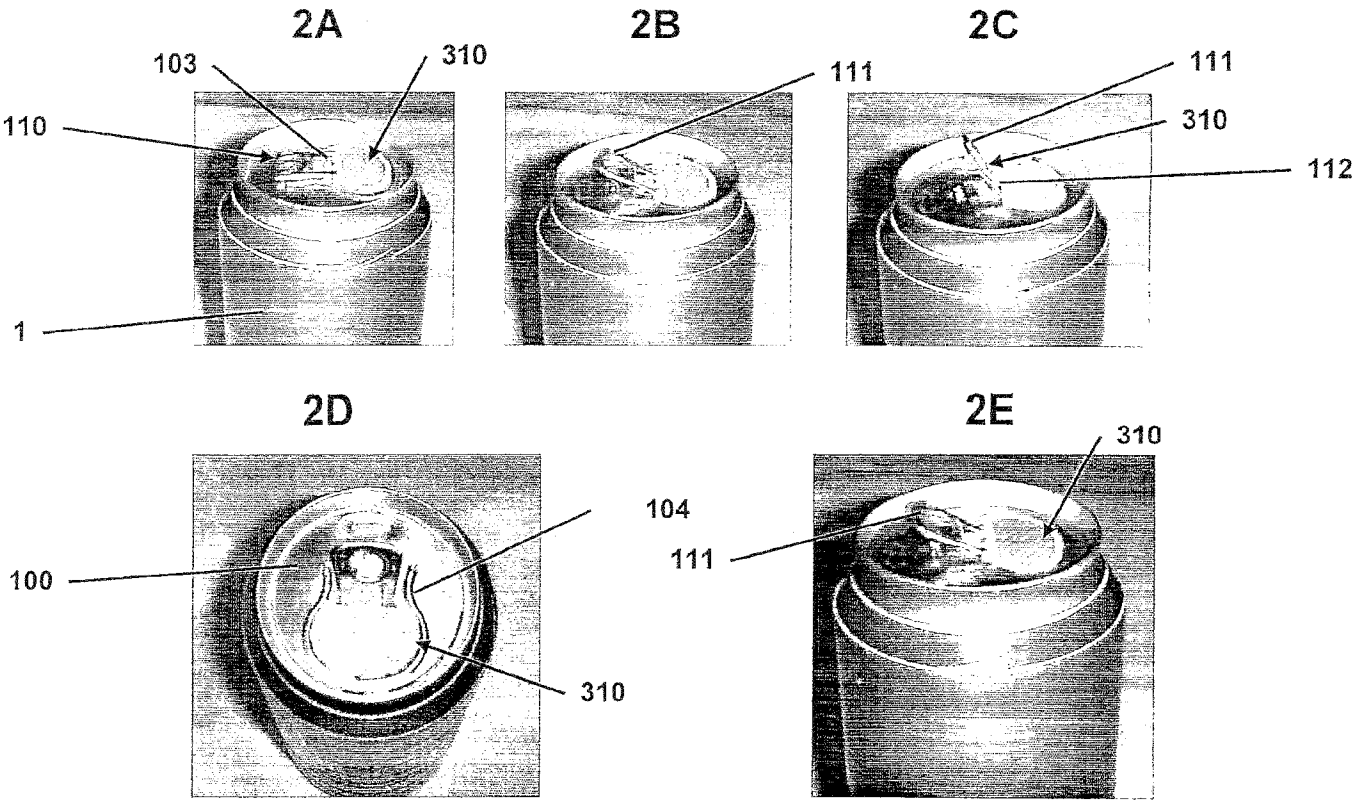
FIG. 2 shows a first embodiment of the present invention in a beverage can of FIG. 1.

FIG. 2 shows a first embodiment of the invention wherein a filter element 310 is fasted to the fixing 103 of the can 1 in addition to the tab 110. As shown in FIG. 2A the tab 110 is in an initial position and the filter element 310 is pre placed over the sealing element 101 (not visible). In order to raise the handle 111 of tab 110 as shown in FIG. 2B, the sealing element 101 of the can 1 is pressed down into the can, corresponding to what is shown in FIG. 1B, so that the tab 110 is bent upward as further shown in FIGS. 2C and 2D. The filter element 310 preferably contains a locking device for locking the filter over the opening after the can has been opened. In this manner, the filter element 310 remains positioned over the opening of the can independently of the angle of the handle 110, which should be bent down again after opening the can, in order to drink from the can as shown in FIG. 2E.

The locking devices locking the filter element to the top of the can may for example be small hooks or protrusions, punched out of the filter element snapping to the underside of the punch edge 102, such as by pressing the filter element 310 against the top of the can, e.g. by using the grip mentioned above. Alternatively, a glue or an elastic material may be used to lock or wedge the filter element under the edge of the opening.

Figure 3:
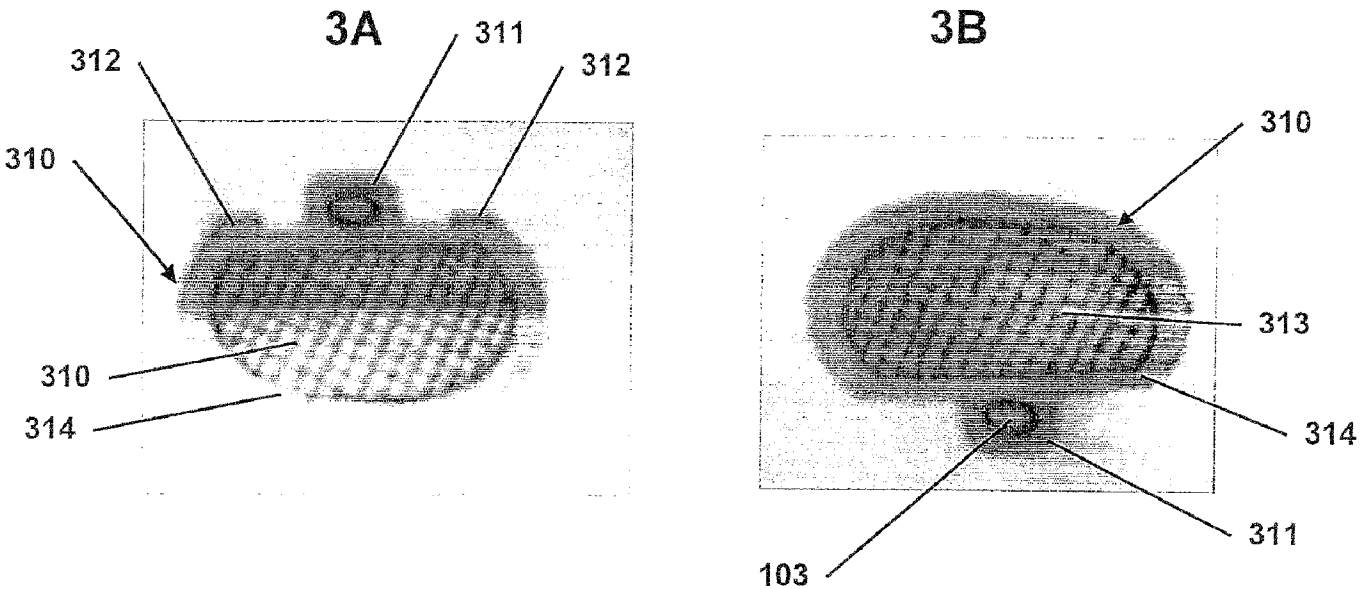
FIG. 3 shows the embodiment in FIG. 2 in detail.

In FIG. 3 a filter element 310 is shown in greater detail. As may be seen in FIG. 3A, the filter element may contain two protrusions 312 in the rear outer edge on each side of the rear tongue 311 connected to the fixing 103 of the can. The protrusions 311 lock the filter element 103 in the correct directional position in relation to the tab 110 of the can. The tongue 311 connected to the fixing must be of such a length that the tab 110 may cause opening of the sealing element 101 with press element 112, past filter element 310, without affecting the filter element. An embodiment may be envisaged wherein the protrusions 312 are not necessary as shown in FIG. 3B. The need is dependant on the shape of the handle and positioning thereof.

The filter element 310 is equipped with a filter or screen 313, such as in the form of holes, slits or a (wire) screen material, preferably a screen material, enabling drinking from a can in a normal manner, without insects or foreign objects entering into the can 1.

The filter element 313 may be of any type hindering foreign object in entering the can. The filter may comprise holes punched or drilled out in a piece of sheet, e.g. a sheet of aluminum or metallic foil, such as aluminum foil, or other material, such as a plastic foil, especially a aluminum foliated or coated plastic film. Further, the filter may be obtained by using slits, such as straight or arched or a combination thereof. The slits or holes may for example spell a word such as the product name. Preferably the filter consists of a fine mesh, such as a screen of aluminum threads, synthetic fibers or similar, most preferably aluminum threads, in order to obtain a homogenous product which easily may be recyclable. Such a mesh may be fastened as an inlay under the edge fold of the outer edge 314 of the filter. The edge folds are preferably situated on the bottom side of the filter element 310 where the metal is folded or rolled several times in order to obtain increased bending strength, so that the filter element 310 resists the load of being pressed against the opening of the can 1. In a similar manner, parts of the metal may be rolled so that it forms a hook on the bottom side of the filter element, such as a hook described above.

The advantage of this embodiment is further that the filter element 310, which is essentially free before use, except for the fixing 103, may easily be sealed for hygienic considerations. During production, an impermeable sealing tape may be placed over the entire filter element 310, for example in order to also cover the whole punch edge 102 of the can 1. The sealing tape may easily be removed by an adapted unglued tap, preferably with good marking, which the user may use to remove the sealing tape before use. Possibly, the sealing tape is pulled towards the outer edge of the top of the can 100 and remains fastened along the outer edge so that it forms an intermediate foil between the can and the mouth of the user. In an alternative embodiment the filter element 310 itself may be sealed in a sealing foil covering the main part of the filter element not fasted to the can in the fixing 103. This may for example be performed by using shrinking plastic. By this embodiment, the plastic may be applied before the filter element is fastened to the can, which may simplify the production of the cans with filter. The shrinking plastic may alternatively be glued to the top of the can to hinder that dirt enters underneath the filter element.

Figure 4:
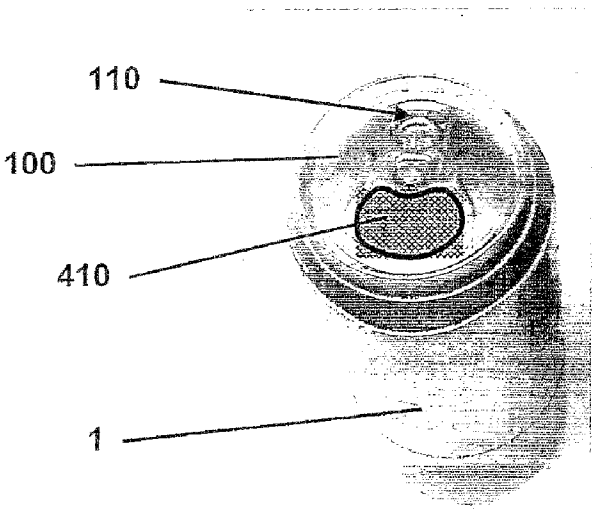
FIG. 4 shows a second embodiment of the present invention.
Figure 4:
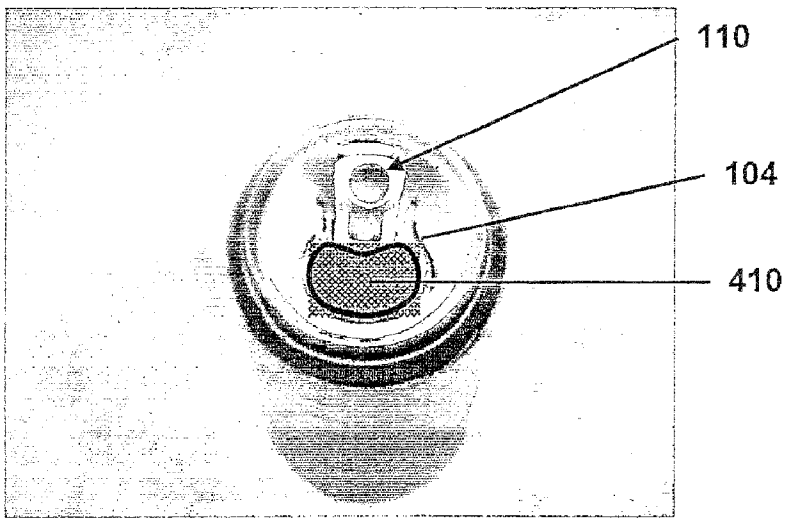

In FIG. 4, a second embodiment of the invention is shown wherein a filter element 410 is glued directly to the top of the can 100, especially within the recess 104 of the top of the can 100. The filter element 410 is only glued in the outer edge so that the can may be opened by the sealing element 101 being pressed downward into the can without the filter element 410 being affected, as shown in FIG. 4B. The material used for the filter element may be a thin perforated aluminum sheet, a sheet of screen mesh, such as in the first embodiment, or a perforated aluminum tape. Preferably, the filter element 410 is produced in a form of aluminum so that the material is homogenic with the beverage can, which is an advantage for recycling.

Figure 5:
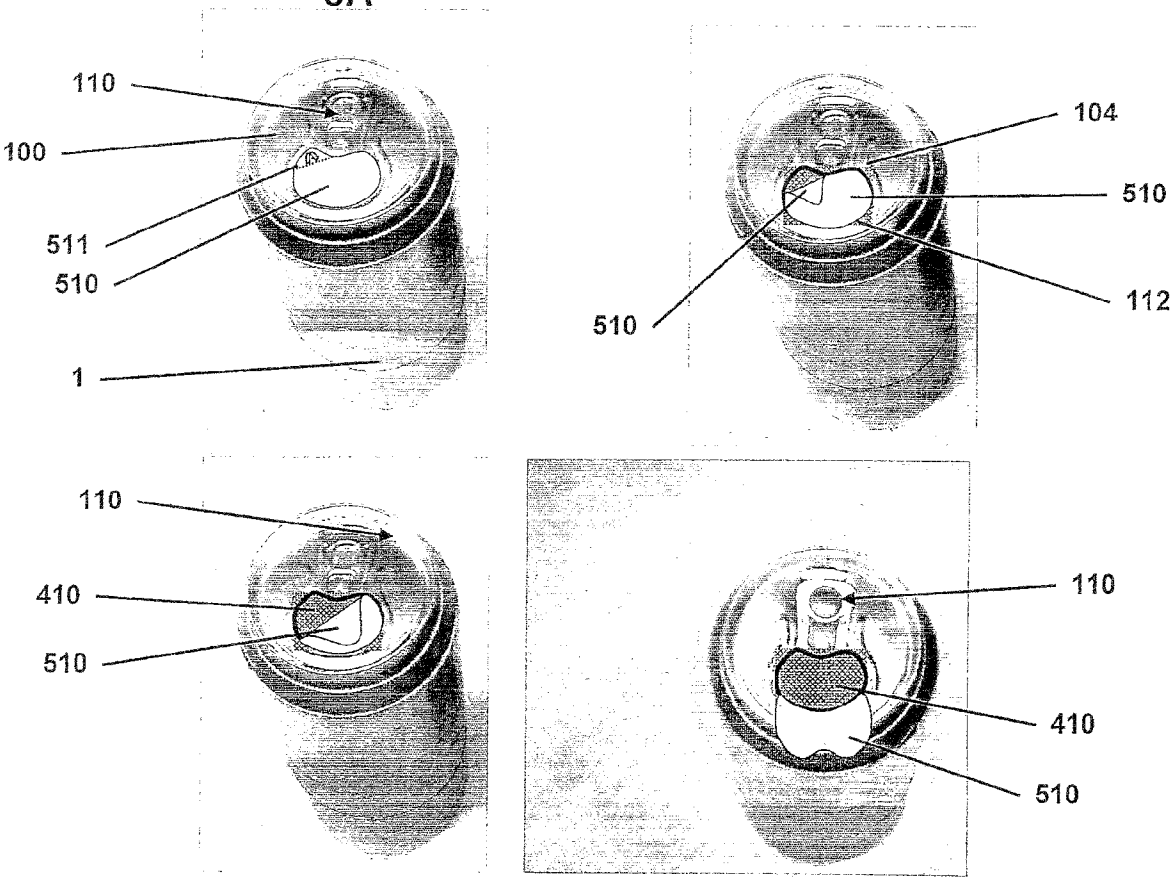
FIG. 5 shows a third embodiment of the present invention.

In FIG. 5 a third embodiment of the invention is shown wherein the filter element 410 in the above embodiment is covered by a hygienic tape 510. As shown ill FIG. 5A, the hygienic tape 510 may have one or more (not shown) opening taps 511 which the user may pull. By pulling the hygienic tape 510 as shown in FIG. 5B-5C the access to the can is opened via the filter element 410 lying under the tape. The hygienic tape 510 may preferably be especially glued to the outer edge portion of the top of the can so that it may remain in parts of this area. As shown in FIG. 5D, the hygienic tape 510 will thereby function as a protector against the can edge, so that the users mouth will not come into contact with the can. This is an important hygienic advantage as the outside of the can is not necessarily clean. Cans may by stored outdoors in hot areas where animals and dirt may have been in contact with the cans.

The hygienic tape 510 may have any shape and cover larger parts of the top of the can than what is shown in the Figures. For example, the tape may cover half of the top of the can so that it may cover a larger part of the can when partly removed to reduce the chance of the user coming into direct contact with the outside of the can. In one embodiment the hygienic tape may be of a formable material, such as aluminum foil which may be formed about the edge of the can. In this manner the hygienic tape 510 or the hygienic foil will be better fastened about the edge of the can, and this close contact will make it easier for the user to drink from the can as the contact and closure with the mouth is better. Alternatively or in addition, another protective tape may be mounted over the top surface of the hygienic tape itself, for example of the same shape, which by removal exposes an adhesive applied to the top side of the hygienic tape, so that the hygienic tape 520 in its turn may be fastened to the edge of the can and the outer side of the can walls when the hygienic tape 510 is folded over the edge of the can before use.

Figure 6:
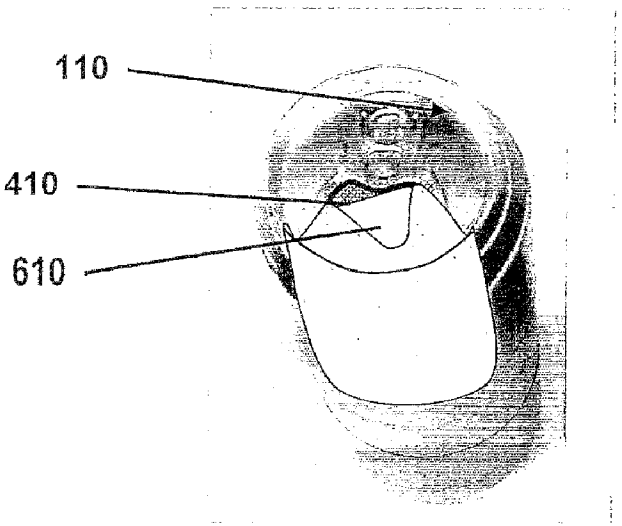
FIG. 6 shows a forth embodiment of the present invention.
Figure 6:
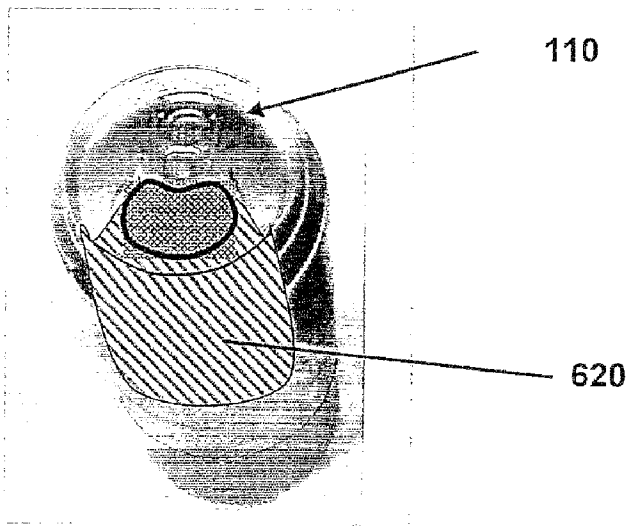

In a forth alternative embodiment as shown in FIG. 6A, the hygienic tape 610 is of a size covering an area of the top of the can and an area on the wall of the can, again to avoid any contact of the lips of the user with the can. The hygienic tape 610 may also in an alternative embodiment be lined with a lining tape 620 position between the can and the hygienic tape 610, with a size and shape similar to that of the hygienic tape 610. The lining tape is adhered to the can, preferably in a permanent manner, covering both an area of the top of the can and the wall of the can. By removing the hygienic tape 610, the clean and preferably sterile surface of the lining tape 620 is revealed as shown in FIG. 6 B, covering the entire contact area of the can. The lining tape may be made of any suitable material such as plastic, metal foil, or a foil like material as described above. In an alternative embodiment, the filter element may also be an integrated part of the lining tape 620. The filter element may be of the same material as the lining tape, such as plastic or other different such as a screen of synthetic fibers of aluminum threads.

All the hygienic tapes mentioned above may of course be pre mounted by a producer of can tops or cans, by a beverage producer during filling of cans, or may be delivered separately for the consumer to adhere to the can.

ALTERNATIVE EMBODIMENTS

Alternatively the filter elements of the present invention are used to hinder bodies within the can from exiting the can, such as for filtering fruit meat from juice from the can or lumps that may occur in certain special products. The filter element will also hinder elements which by mistake have entered the can, which may be dangerous, especially for children.

The present invention is not limited to aluminum cans. Other types of material than aluminum are also envisaged and will depend on what the beverage industry chooses as packing material. Similar cans may for example be envisaged produced in plastic, laminated or coated paper board, composite material, or other metals such as suitable steel types or a combination of different materials which preferable may be recyclable.

Further, the size and shape of the beverage can may vary, as cans are produced for different volumes, with different diameters and height, and even varying diameters and diameter shape (round, oval, multisided etc.). All such variations of the dimensions and shapes are envisaged. The term "conventional" can is therefore to be understood as a can being produced on an industrial scale.

The invention claimed is:

1. A filter element (310, 410) for a conventional beverage can (1, 2), with a top of a can (100) comprising a pull tab with a fixing (103), a tab (110), and a sealing element (101) which at least adjoins to a punch edge (102) of an opening of the can, wherein the filter element has an area covering an entirety of said opening when the can is opened, and the filter element is adapted to be fastened to a top side of the top of the can (100) by one of i) the fixing (103) of the pull tab and ii) adherence directly to the top of the can (100), wherein the filter element (310, 410) comprises one or more locking devices configured to lock the filter element to the opening of the can, wherein at least an entirety of the filter element is covered by a removable hygienic tape (510), wherein a lining tape (620) is positioned between the can and the hygienic tape (610), and wherein the filter element is integrated in the lining tape (620).

2. The filter element according to claim 1, wherein the locking device is selected from the group consisting of snap hooks, glue, and an elastic material configured to be locked or wedged under the edge of the opening.

3. The filter element according to claim 1, wherein the filter element is mounted over the pull tab (110), covering a press part (112) of the pull tab (110).

4. The filter element according to claim 1, wherein the fixing (103) of the pull tab is a conventional peg.

5. The filter element according to claim 1, wherein the filter element is made of plastic or metal.

6. The filter element according to claim 5, wherein the filter element has the form of one of aluminum plate, aluminum foil, and plastic film.

7. The filter element according to claim 5, wherein the filter element has the form of a metallic foiled plastic film.

8. The filter element according to claim 1, wherein the filter element (310) further comprises a tongue (311) in a rear portion nailed in the fixing (103) together with the tab (110).

9. The filter element according to claim 1, wherein the filter element further comprises two protrusions (312) on each side of a rear tongue (311) configured to lock the filter element (310) in a correct position in relation to the tab (110) and the sealing element (101).

10. The filter element according to claim 1, wherein the filter element further comprises perforations.

11. The filter element according to claim 10, wherein the perforations have the form of any of holes, slits, or a combination thereof.

12. The filter element according to claim 10, wherein the perforations have the form of any of straight and arched slits.

13. The filter element according to claim 1, wherein the filter element is positioned within a recess (104) or ridges or grooves in the top of the can (100).

14. The filter element according to claim 1, wherein the hygienic tape (510) locally is permanently fastened to parts of the can.

15. The filter element according to claim 1, wherein the filter element further comprises one or more openings covered by a screen.

16. The filter element according to claim 15, wherein the screen comprises a fine wire netting.

17. The filter element according to claim 15, wherein the screen is a netting formed of one of aluminum threads, plastic threads, and synthetic fibres.

18. The filter element according to claim 15, wherein the screen is a netting of aluminum threads.

19. The filter element according to claim 15, wherein the screen is fastened underneath folds one an outer edge of the filter element (314) as an inlay.

20. The filter element according to claim 1, wherein the hygienic tape (510) is made of a formable material formable over the edge of the top of the can.

21. The filter element according to claim 1, wherein the lining tape is made of plastic, metal foil, a combination thereof or the same material as the hygienic tape.

22. A top of a can, comprising a filter element according to claim 1.

23. A beverage can, comprising a filter element according to claim 1.

24. The filter element according to claim 1, wherein the hygienic tape (510) comprises one or several opening tabs (511).

25. The filter element according to claim 1, wherein the filter element is one of i) a same material as the lining tape and ii) in the form of a screen comprising one of synthetic fibres and aluminum threads.

26. A top of a can, characterized in that it comprises a filter element according to claim 25.

27. A beverage can, characterized in that it comprises a filter element according to claim 25.

28. A filter element for a conventional beverage can (1, 2), with a top of a can (100) comprising a pull tab with a fixing (103), a tab (110), and a sealing element (101) which at least adjoins to a punch edge (102) of an opening of the can, wherein the filter element has an area covering an entirety of said opening when the can is opened, and the filter element is adapted to be fastened to a top side of the top of the can (100) by one of i) the fixing (103) of the pull tab and ii) adherence directly to the top of the can (100), wherein the filter element (310, 410) comprises one or more locking devices configured to lock the filter element to the opening of the can, wherein at least an entirety of the filter element is covered by a removable hygienic tape (510), wherein the hygienic tape (510) is foldable over a top edge of the can in order to hinder contact between a user's lips and the can, and wherein the hygienic tape (510) has a protective tape which by removal exposes an adhesive on a top side of the hygienic tape (510) to enable fastening of a folded part of the hygienic tape (510) to the can.

29. A filter element for a conventional beverage can (1, 2), with a top of a can (100) comprising a pull tab with a fixing (103), a tab (110), and a sealing element (101) which at least adjoins to a punch edge (102) of an opening of the can, wherein the filter element has an area covering an entirety of said opening when the can is opened, and the filter element is adapted to be fastened to a top side of the top of the can (100) by one of i) the fixing (103) of the pull tab and ii) adherence directly to the top of the can (100), wherein the filter element (310, 410) comprises one or more locking devices configured to lock the filter element to the opening of the can, wherein at least an entirety of the filter element is covered by a removable hygienic tape (510), wherein a lining tape (620) is positioned between the can and the hygienic tape (610), and wherein the lining tape (620) is permanently fastened to the can.

30. The filter element according to claim 29, wherein the lining tape (620) covers parts of the top of the can and parts of the wall of the can.

31. A top of a can, characterized in that it comprises a filter element according to claim 29.

32. A beverage can, characterized in that it comprises a filter element according to claim 29.

33. A filter element (310, 410) for a conventional beverage can (1, 2), with a top of a can (100) comprising a pull tab with a fixing (103), a tab (110) and a sealing element (101) which at least adjoins to a punch edge (102) of an opening of the can, wherein the filter element has an area covering an entirety of said opening when the can is opened, and the filter element is adapted to be fastened to a top side of the top of the can (100) by adherence directly to the top of the can (100), wherein at least the filter element is covered by a removable hygienic tape (510), and wherein the filter element comprises one of i) perforations and ii) a screen fastened underneath the folds on the outer edge of the filter element (314) as an inlay and covering one or more openings in the filter element.

34. The filter element according to claim 33, wherein the filter element is mounted over the pull tab (110), covering a press part (112) of the pull tab (110).

35. The filter element according to claim 33, wherein the filter element is made of plastic or metal.

36. The filter element according to claim 35, wherein the filter element has the form of one of aluminum plate, aluminum foil, and plastic film.

37. The filter element according to claim 35, wherein the filter element has the form of a metallic foiled plastic film.

38. The filter element according to claim 33, wherein the screen comprises a fine wire netting.

39. The filter element according to claim 33, wherein the screen is a netting formed of one of aluminum threads, plastic threads, and synthetic fibres.

40. The filter element according to claim 33, wherein the screen is a netting of aluminum threads.

41. A filter element (310, 410) for a conventional beverage can (1, 2), with a top of a can (100) comprising a pull tab with a fixing (103), a tab (110) and a sealing element (101) which at least adjoins to a punch edge (102) of an opening of the can, wherein the filter element has an area covering an entirety of said opening when the can is opened, and the filter element is adapted to be fastened to a top side of the top of the can (100) by adherence directly to the top of the can (100), wherein at least an entirety of the filter element is covered by a removable hygienic tape (510), wherein the hygienic tape (510) is foldable over a top edge of the can in order to hinder contact between a user's lips and the can, and wherein the hygienic tape (510) has a protective tape which by removal exposes an adhesive one a top side of the hygienic tape (510) to enable fastening of the folded part of the hygienic tape (510) to the can.

42. The filter element according to claim 41, wherein the hygienic tape (510) locally is permanently fastened to parts of the can.

43. The filter element according to claim 41, wherein the hygienic tape (510) is made of a formable material being formable over the edge of the top of the can.

44. A filter element (310, 410) for a conventional beverage can (1, 2), with a top of a can (100) comprising a pull tab with a fixing (103), a tab (110) and a sealing element (101) which at least adjoins to a punch edge (102) of an opening of the can, wherein the filter element has an area covering an entirety of said opening when the can is opened, and the filter element is adapted to be fastened to a top side of the top of the can (100) by adherence directly to the top of the can (100), wherein at least an entirety of the filter element is covered by a removable hygienic tape (510), wherein a lining tape (620) is positioned between the can and the hygienic tape (610), and wherein the filter element is integrated in the lining tape (620).

45. The filter element according to claim 44, wherein the lining tape (620) is permanently fastened to the can.

46. The filter element according to claim 44, wherein the lining tape (620) covers both parts of the top of the can and parts of the wall of the can.

47. The filter element according to claim 44, wherein the lining tape is made of one of i) a same material as the hygienic tape and ii) any of plastic and metal foil.

48. A top of a can, characterized in that it comprises a filter element according to claim 44.

49. A beverage can, characterized in that it comprises a filter element according to claim 44.

* * * * *